US011441500B2

(12) United States Patent
Ogawa et al.

(10) Patent No.: US 11,441,500 B2
(45) Date of Patent: Sep. 13, 2022

(54) ENGINE TORQUE ESTIMATING APPARATUS, ENGINE TORQUE ESTIMATING METHOD, AND ENGINE CONTROL APPARATUS

(71) Applicant: TRANSTRON INC., Yokohama (JP)

(72) Inventors: Masatoshi Ogawa, Yokohama (JP); Hiromitsu Soneda, Yokohama (JP)

(73) Assignee: TRANSTRON INC., Yokohama (JP)

( * ) Notice: Subject to any disclaimer, the term of this patent is extended or adjusted under 35 U.S.C. 154(b) by 0 days.

(21) Appl. No.: 17/399,890

(22) Filed: Aug. 11, 2021

(65) Prior Publication Data

US 2021/0372334 A1 Dec. 2, 2021

Related U.S. Application Data

(63) Continuation of application No. PCT/JP2019/007097, filed on Feb. 25, 2019.

(51) Int. Cl.
*F02D 41/00* (2006.01)

(52) U.S. Cl.
CPC .... *F02D 41/009* (2013.01); *F02D 2200/0614* (2013.01); *F02D 2200/1002* (2013.01)

(58) Field of Classification Search
CPC ..... F02D 41/00; F02D 41/009; F02D 41/14; F02D 41/1433; F02D 41/1497;
(Continued)

(56) References Cited

U.S. PATENT DOCUMENTS 6,041,647 A * 3/2000 Matsuoka ..... F02D 41/009 123/90.17
7,194,899 B1 * 3/2007 Chen ..... F02D 41/0097 73/114.25

(Continued)

FOREIGN PATENT DOCUMENTS

DE 102015102249 A1 8/2016
EP 3686417 A1 7/2020

(Continued)

OTHER PUBLICATIONS

Written Opinion of International Searching Authority for International Application No. PCT/JP2019/007097, dated Apr. 9, 2019.

(Continued)

*Primary Examiner* — John Kwon
*Assistant Examiner* — Johnny H Hoang
(74) *Attorney, Agent, or Firm* — Staas & Halsey LLP

(57) ABSTRACT

An engine torque estimating apparatus having a processor and a memory accessed by the processor. The processor performs a torque estimating that calculates time series data of an estimated indicated torque, based on a crank angle having been extracted from an output of a crank angle sensor of an engine including a plurality of cylinders; an estimated indicated torque-related value extracting that extracts an estimated indicated torque-related value, for each of the cylinders, from the time series data of the estimated indicated torque, for each of the cylinders; and average indicated torque correct value acquiring that converts, for each of the cylinders, the estimated indicated torque-related value into an average indicated torque correct value having been calculated based on a cylinder internal state of the engine in correspondence to the estimated indicated torque-related value.

10 Claims, 10 Drawing Sheets

(58) Field of Classification Search
CPC ..... F02D 41/28; F02D 2200/0614; F02D 2200/1002; F02D 2041/1433; G01M 15/00; G01M 15/06; G01L 3/04
See application file for complete search history.

(56) References Cited

U.S. PATENT DOCUMENTS

| | | | | |
|---|---|---|---|---|
| 10,138,838 | B2 * | 11/2018 | Ogawa | F02D 41/0097 |
| 2005/0071073 | A1 * | 3/2005 | Ueda | F02P 5/1506 701/101 |
| 2009/0100920 | A1 * | 4/2009 | Sakayanagi | F02D 41/022 73/114.15 |
| 2009/0282903 | A1 | 11/2009 | Nagano et al. | |
| 2017/0115172 | A1 * | 4/2017 | Ogawa | F02D 41/28 |
| 2019/0011319 | A1 * | 1/2019 | Ogawa | G01M 15/08 |

FOREIGN PATENT DOCUMENTS

| | | |
|---|---|---|
| JP | 9-126041 | 5/1997 |
| JP | 2005-61371 | 3/2005 |
| JP | 2005-113877 | 4/2005 |
| JP | 2005-201163 | 7/2005 |
| JP | 2009-13904 | 1/2009 |
| JP | 2010-127219 | 6/2010 |
| JP | 2013-163436 A | 8/2013 |
| JP | 2017-82662 | 5/2017 |
| WO | 2017/158838 | 9/2017 |

OTHER PUBLICATIONS

English Translation of International Search Report for International Application No. PCT/JP2019/007097, dated Apr. 9, 2019.
Shuichi Adachi et al.; Fundamentals of Kalman Filter, Tokyo Denki University Press, ISBN 978-4-501-32891-0 C3055, pp. ii-iii.
Michael Henn et al.; "Estimation of In-Cylinder-Pressure Torque from Angular Speed by Kalman Filtering"; Advances in Automotive Control 1995, Jan. 1, 1995; Elsevier, XP055727320, pp. 21-26, DOI: 10.1016/B978-0-08-042589-4.50007-8; (6 pages).
Extended European Search Report dated Feb. 2, 2022 in related European Patent Application No. 19916661.2 (9 pages).
Notice of Reasons for Refusal dated Jul. 5, 2022 in corresponding Japanese Patent Application No. 2021-501399 (2 pages) (5 pages English Translation).

* cited by examiner

ENGINE TORQUE ESTIMATING APPARATUS, ENGINE TORQUE ESTIMATING METHOD, AND ENGINE CONTROL APPARATUS

CROSS-REFERENCE TO RELATED APPLICATION

This application is a continuation application of International Application Number PCT/JP2019/007097 filed on Feb. 25, 2019 and designated the U.S., the entire contents of which are incorporated herein by reference.

FIELD

The present invention relates to an engine torque estimating apparatus, an engine torque estimating method, and an engine control apparatus.

BACKGROUND

A control apparatus of a gasoline engine or a diesel engine for an automobile performs torque-based control in which the engine is controlled based on torque. In torque-based control, a needed torque is set based on an accelerator operation by a driver, cruise control, or the like, an indicated torque that satisfies the needed torque is calculated, and an injection amount of an injector is controlled so as to enable the indicated torque to be reproduced. Such engine control is referred to as feed-forward control.

In feed-forward control, injection amounts of injectors of a plurality of cylinders of a multi-cylinder engine are controlled in a same manner. However, individual variability among the respective injectors of the plurality of cylinders creates variability among the indicated torques of the plurality of cylinders and causes deterioration in emission performance and fuel economy performance.

On the other hand, feedback control is proposed in which an indicated torque of each cylinder of an engine is estimated based on a sensor value (an observed value or an output value) of a crank angle sensor and an injection amount of an injector of each cylinder is separately controlled so that an estimated indicated torque of each cylinder matches a needed torque.

PATENT LITERATURE

Patent Literature 1: Japanese Patent Application Laid-open No. 2010-127219

Patent Literature 2: Japanese Patent Application Laid-open No. 2017-82662

NON-PATENT LITERATURE

Non-Patent Literature 1: Fundamentals of Kalman Filter, Shuichi Adachi, Ichiro Maruta, Tokyo Denki University Press, ISBN 978-4-501-32891-0 C3055

However, due to a limit of measurement resolution in crank angle extraction of a crank angle sensor, a limit of a sampling period of voltage output of the crank angle sensor, a disturbance such as vibration inside the engine in a high-rotation region, and the like, a sensor value of the crank angle sensor contains a different noise in a combustion cycle of each cylinder. Therefore, it is difficult to accurately estimate an indicated torque of each cylinder based on a sensor value of a crank angle sensor. Due to such reasons, feedback control based on an estimated indicated torque of each cylinder is prevented from being performed in a suitable manner.

SUMMARY

According to an embodiment, an engine torque estimating apparatus includes a processor; and a memory accessed by the processor, the processor performs a torque estimating that calculates time series data of an estimated indicated torque, based on a crank angle having been extracted from an output of a crank angle sensor of an engine including a plurality of cylinders; an estimated indicated torque-related value extracting that extracts an estimated indicated torque-related value, for each of the cylinders, from the time series data of the estimated indicated torque, for each of the cylinders; and average indicated torque correct value acquiring that converts, for each of the cylinders, the estimated indicated torque-related value into an average indicated torque correct value having been calculated based on a cylinder internal state of the engine in correspondence to the estimated indicated torque-related value.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Figure 1:
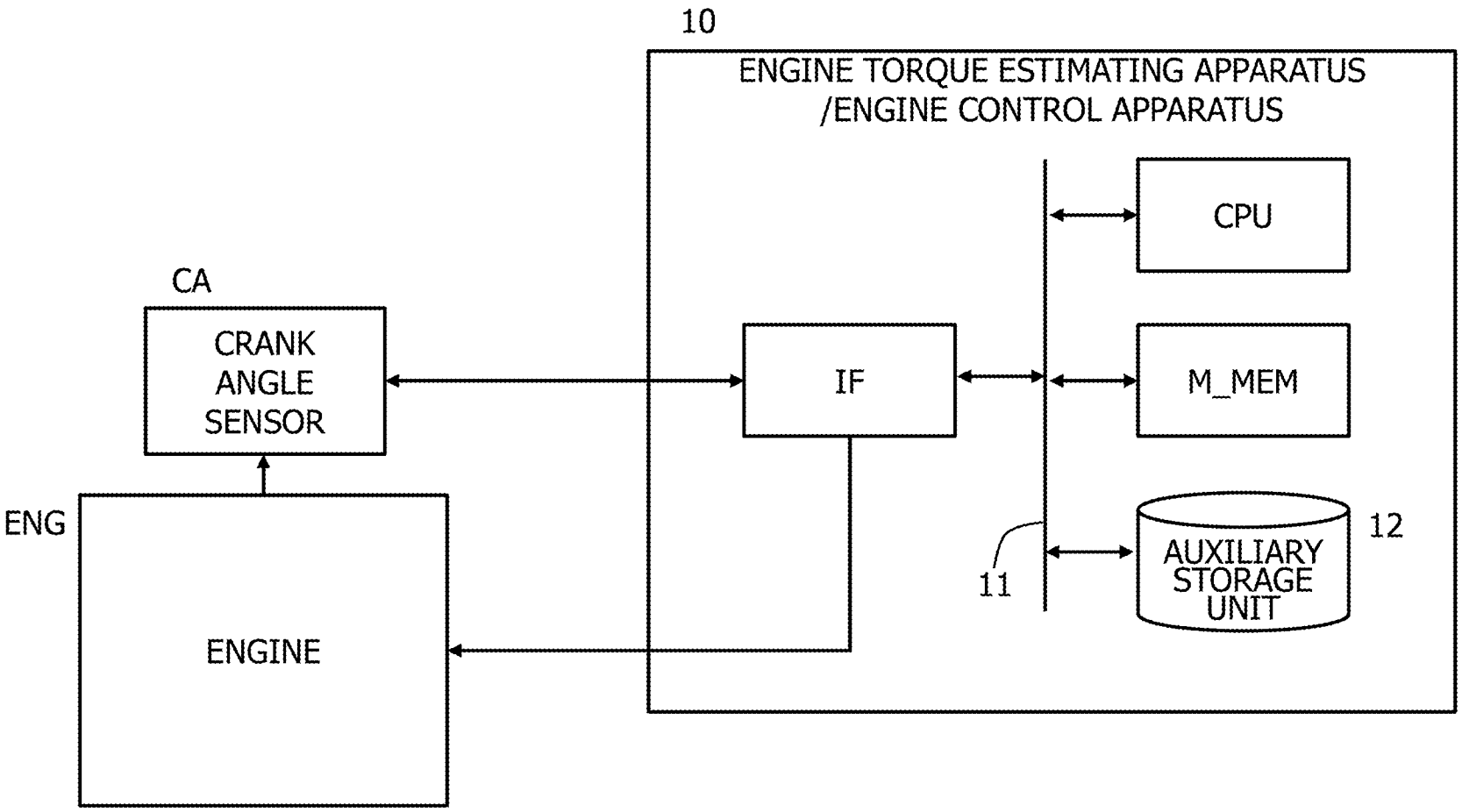
FIG. 1 is a diagram illustrating a schematic configuration of an engine, an engine torque estimating apparatus, and an engine control apparatus.

FIG. 1 is a diagram illustrating a schematic configuration of an engine, an engine torque estimating apparatus, and an engine control apparatus. An engine ENG is a gasoline engine or a diesel engine to be mounted to a vehicle which uses an engine as a sole drive source, a hybrid vehicle which uses both an engine and an electric motor as drive sources, and the like. The engine ENG is provided with a crank angle sensor CA which detects a rotation angle of a crank shaft. An engine torque estimating apparatus and engine control apparatus 10 is constituted by, for instance, a microcomputer. Specifically, the microcomputer includes an operation processing unit CPU, a main memory M_MEM, an auxiliary storage device 12 that is a non-volatile memory or the like, an interface IF to the outside, and a bus 11 that connects these elements.

The crank angle sensor CA is, for instance, a sensor that detects a reference position and a rotation angle of a crank shaft. A sensor value detected by the crank angle sensor becomes a base signal for fuel injection control and ignition timing control in an electronic fuel injection system. For instance, with an electromagnetic crank angle sensor, a magnetic flux received by the crank angle sensor changes in accordance with a rotation of a rotor with projections (teeth) that is attached to the crank shaft. A change in the magnetic flux is converted into and output as a pulse signal of a rectangular wave. The rotor is provided with a plurality of projections so as to correspond to a crank angle pitch and includes a missing tooth for detecting top dead center. In another example, an optical crank angle sensor detects light that penetrates between projections of a rotor, in which case detected light is converted into and output as a pulse signal of a rectangular wave.

The engine torque estimating apparatus constituted by the micro-computer 10 receives a crank angle extracted from an output pulse of the crank angle sensor CA as an input, and the operation processing unit CPU executes an engine torque estimation program in the auxiliary storage device 12 to calculate an estimated torque such as an estimated indicated torque of each cylinder.

In addition, in the engine control apparatus that is constituted by the microcomputer 10 in a same way, the operation processing unit CPU executes an engine control program in the auxiliary storage device 12, calculates an injector injection amount of the engine ENG based on an internal state of the engine such as the number of rotations, the estimated torque described above, and the like, and performs drive control of the injectors.

Figure 2:
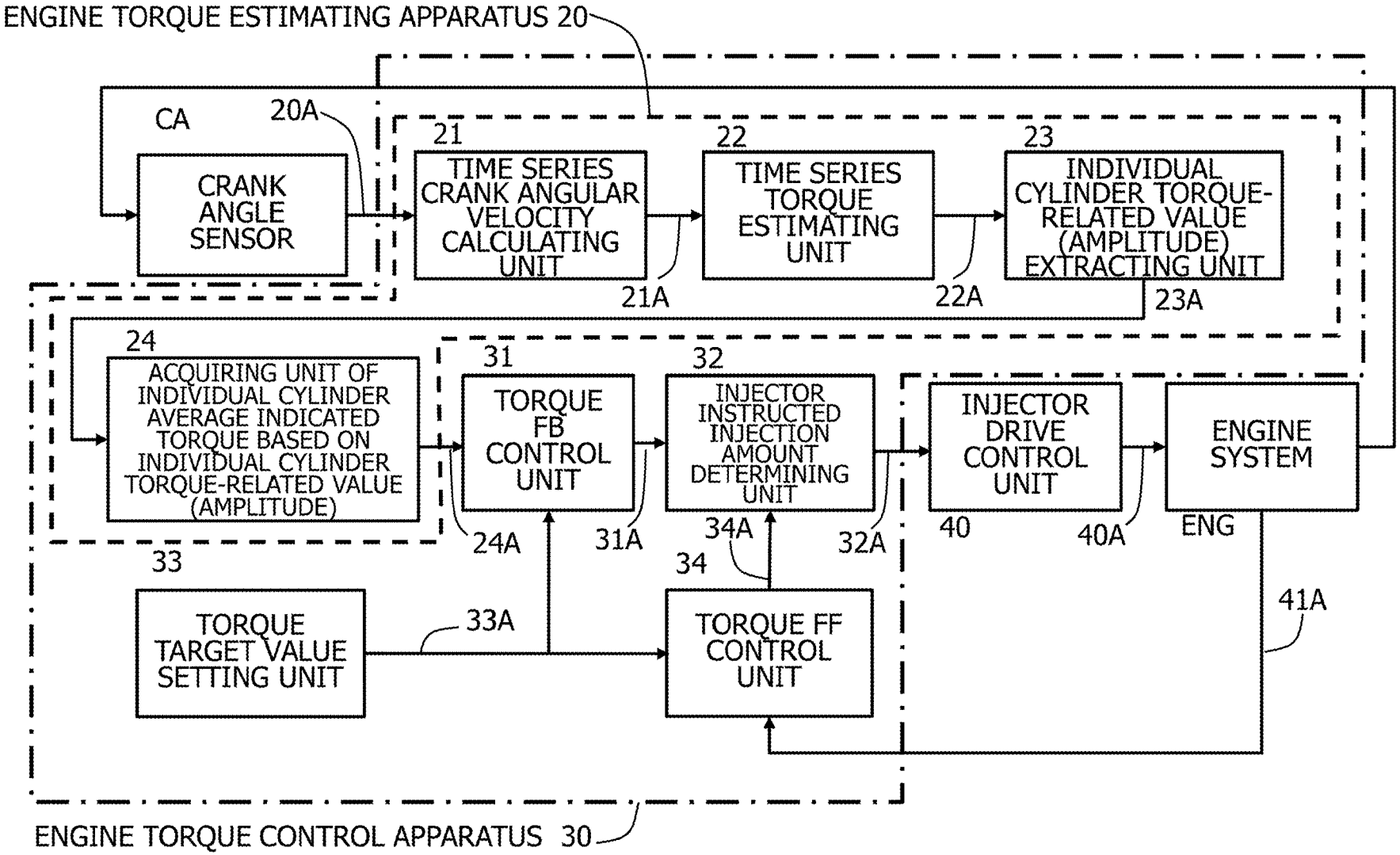
FIG. 2 is a diagram illustrating a configuration of an engine torque estimating apparatus and an engine control apparatus according to the present embodiment.

FIG. 2 is a diagram illustrating a configuration of an engine torque estimating apparatus and an engine control apparatus according to the present embodiment. As described with reference to FIG. 1, in an engine torque estimating apparatus 20, a microcomputer executes an engine torque estimation program to realize respective calculating unit 21, an estimating unit 22, an extracting unit 23, and acquiring unit 24, and the like illustrated in FIG. 2. In addition, an engine control apparatus 30 includes the engine torque estimating apparatus 20, a torque feedback control unit 31, a torque feed-forward control unit 34, an injector instructed injection amount determining unit 32, a torque target value setting unit 33, and the like illustrated in FIG. 2, which a microcomputer executes an engine control program to realize.

Figure 3:
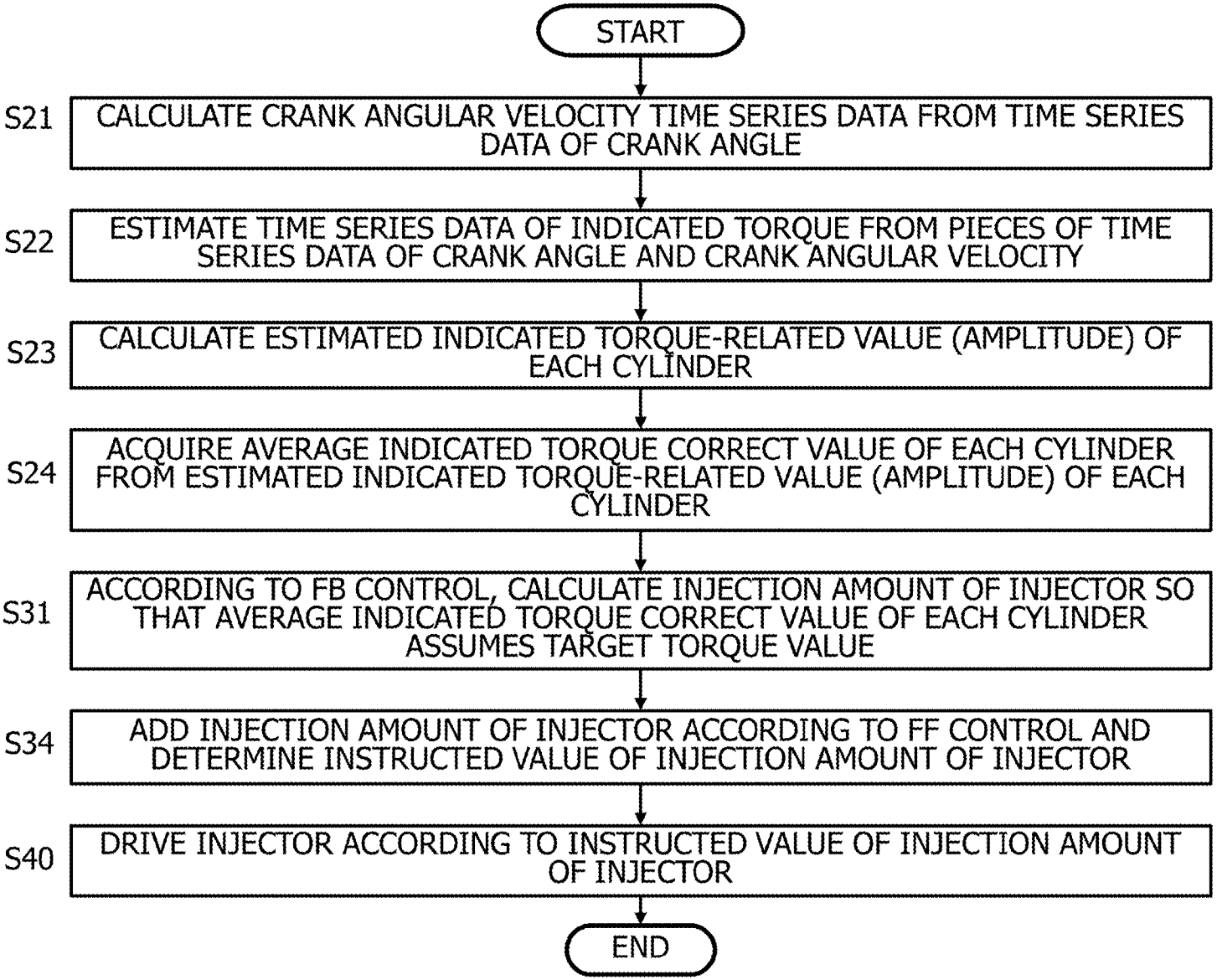
FIG. 3 is a diagram of a flow chart illustrating processing contents of the engine torque estimating apparatus and the engine control apparatus.

FIG. 3 is a diagram of a flow chart illustrating processing contents of the engine torque estimating apparatus and the engine control apparatus. FIG. 3 illustrates contents of processing of the respective calculating units and the like of the engine torque estimating apparatus and the engine control apparatus illustrated in FIG. 2.

The engine torque estimating apparatus 20 receives a voltage output 20A of the crank angle sensor CA as an input and extracts time series data of a crank angle from the voltage output. A time series crank angular velocity calculating unit 21 monitors the pulse-shaped voltage output 20A that is output by the crank angle sensor CA and calculates time series data of the crank angle. Specifically, the time series crank angular velocity calculating unit 21 detects that, when a voltage value output by the crank angle sensor crosses 0 volts when the voltage value output by the crank angle sensor rises and falls, a crank angle θ (k) has advanced by a predetermined minute angle Δθ (p. In addition, assuming that the number of 0-crosses is k, the time series crank angular velocity calculating unit 21 stores time point information t (k) and a following crank angle θ (k).

[Math. 1]

$$\theta(k)=\theta(k-1)+\Delta\theta(k) \tag{1}$$

Furthermore, the time series crank angular velocity calculating unit 21 differentiates the time series data θ (k) of the crank angle by time and calculates time series data 21A of the crank angular velocity according to the following mathematical expression (S21).

[Math. 2]

$$\dot{\theta}(k) = \frac{\Delta\theta(k)}{t(k-1)-t(k)} \tag{2}$$

Next, a time series torque estimating unit 22 estimates time series data of indicated torque based on the time series data of the crank angle and the time series data of the crank angular velocity and outputs time series data 22A of an estimated indicated torque (S22). Among these estimating methods, in a first estimating method, an estimated indicated torque is calculated based on the time series data of the crank angular velocity and a moment of inertia J according to the following mathematical expression.

[Mat. 3]

$$r=J\ddot{\theta} \tag{3}$$

In a second estimating method, an estimated indicated torque is calculated based on the time series data of the crank angle and the time series data of the crank angular velocity using a nonlinear Kalman filter and, in particular, an unscented Kalman filter. Estimation processing using a nonlinear Kalman filter in the second estimating method will be described in detail later.

Figure 4:
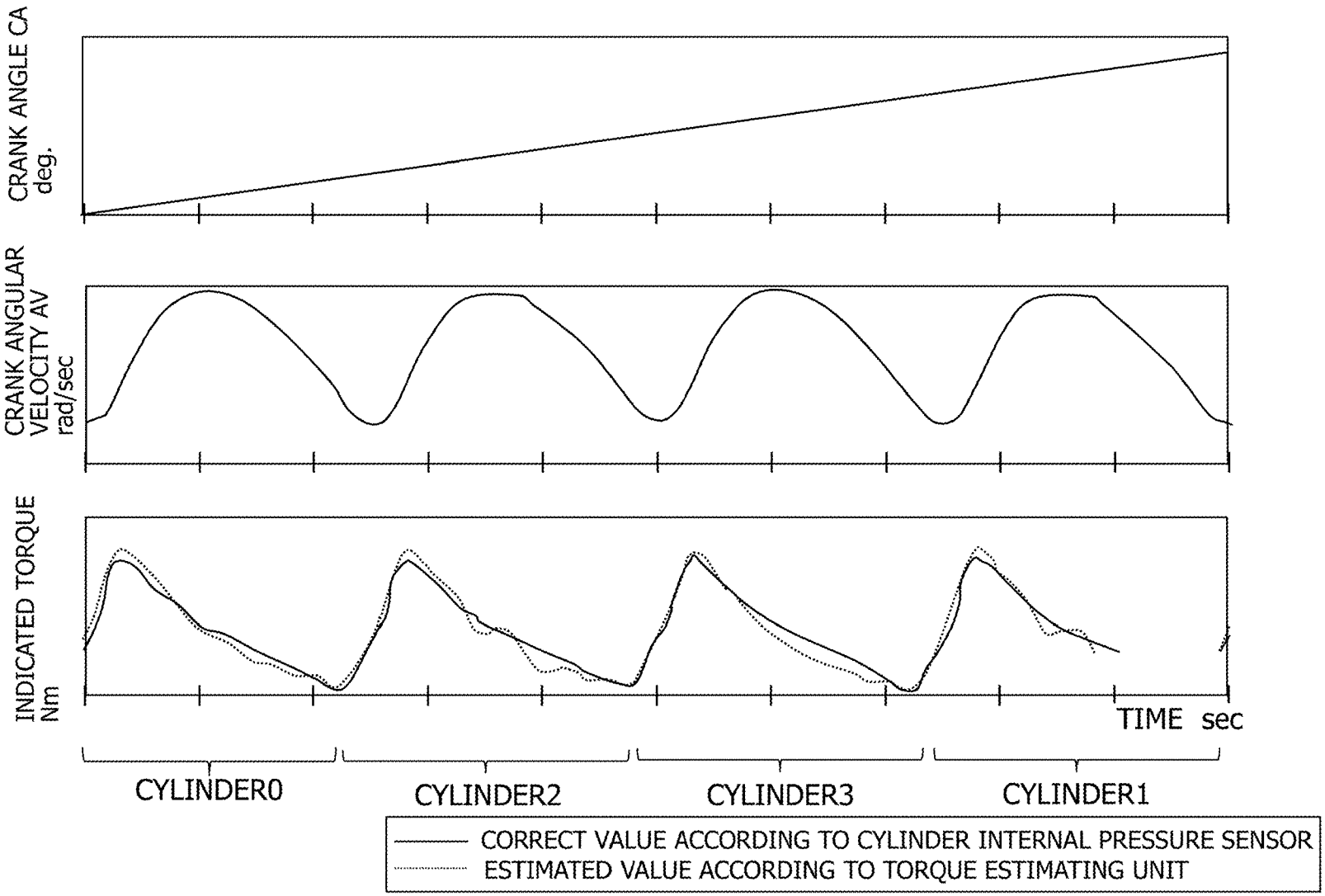
FIG. 4 is a diagram illustrating examples of the time series data of the crank angle, the time series data of the crank angular velocity, and an estimated indicated torque and an indicated torque correct value.
Figure 5:
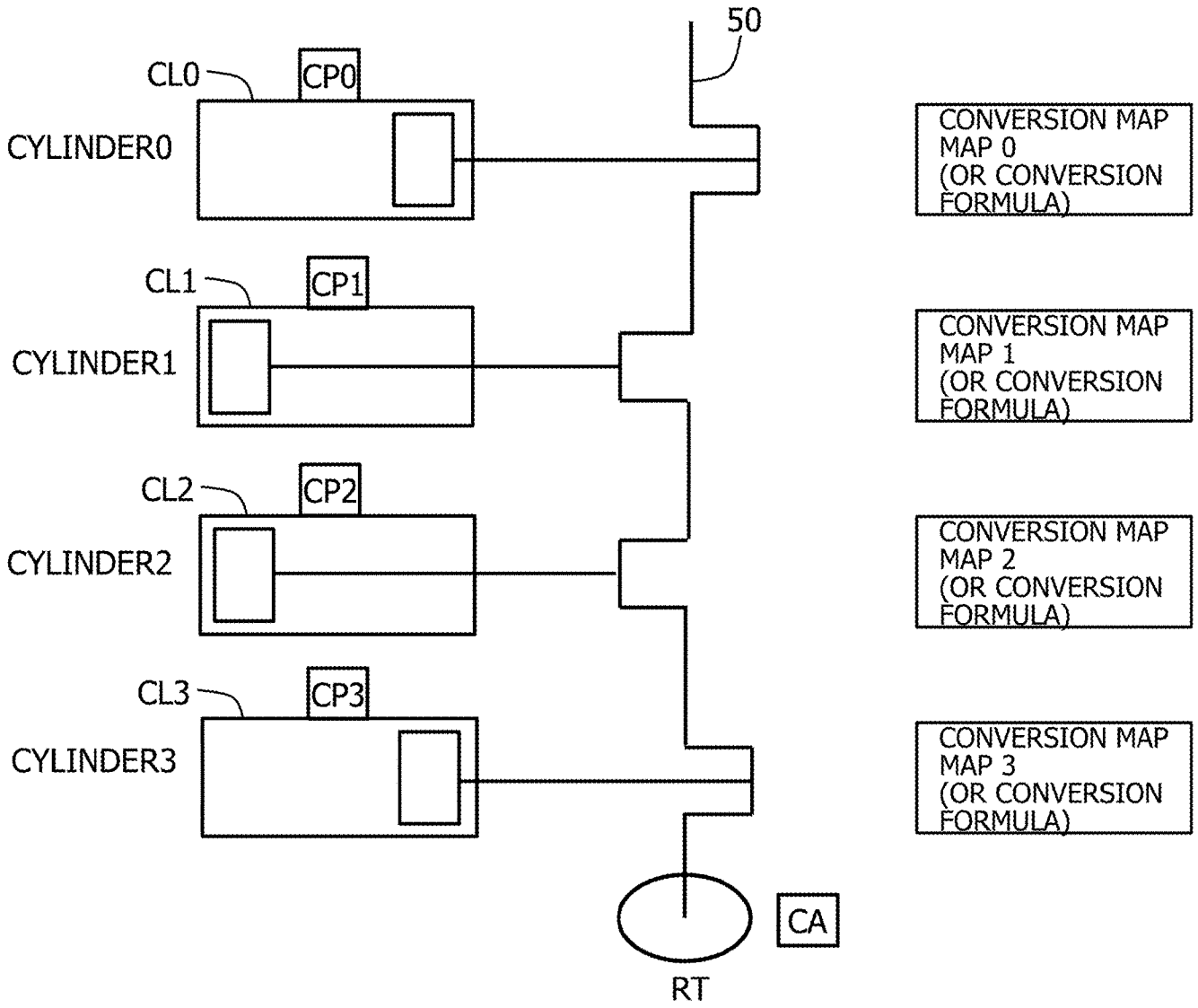
FIG. 5 is a diagram illustrating a schematic configuration of a 4-cylinder engine.

FIG. 4 is a diagram illustrating examples of the time series data of the crank angle, the time series data of the crank angular velocity, and an estimated indicated torque and an indicated torque correct value. FIG. 5 is a diagram illustrating a schematic configuration of a 4-cylinder engine. As illustrated in FIG. 5, the 4-cylinder engine includes four cylinders CL0 to CL3 and a crank shaft 50 respectively connected to pistons PS0 to PS3 inside the respective cylinders. The crank shaft 50 is provided with a rotor RT and the crank angle sensor CA. Teeth surrounding the rotor RT are omitted in the diagram.

In the 4-cylinder engine, a series of operations (cycles) from intake of a mixture of air and gas into a combustion chamber, combustion of the air-fuel mixture, to discharging combustion gas is performed through a total of four strokes of the pistons including two upstrokes and two downstrokes. During a single cycle of the engine, a piston reciprocates inside a cylinder twice and the crank shaft makes two rotations (720 degrees). The respective cylinders CL0 to CL3 perform respective strokes of intake, compression, ignition (combustion), and exhaust at respective offsets of 180 degrees that represent a quarter of one cycle in which the crank shaft 50 rotates twice (720 degrees).

In the time series data of a crank angle having been extracted from a voltage output of the crank angle sensor CA, a crank angle CA increases from 0 degrees to 720 degrees as time elapses on a time axis (an abscissa). On the other hand, in the time series data of a crank angular velocity AV that is obtained by differentiating the crank angle, an increase and a decrease of the crank angular velocity occurs four times in synchronization with the ignition (combustion) stroke of the respective cylinders. For instance, in the example illustrated in FIG. 5, ignition of the cylinder CL0, ignition of the cylinder CL2, ignition of the cylinder CL3, and ignition of the cylinder CL1 occur in this order at respective offsets of 180 degrees, and every time an ignition occurs, the crank angular velocity reaches maximum velocity.

The time series data of the crank angle and the time series data of the crank angular velocity are different time series data in the ignition strokes of the respective cylinders in accordance with individual variability among the respective cylinders. As a result, the time series data of the estimated indicated torque that is calculated by the time series torque estimating unit 22 is respectively different time series data of the estimated indicated torque in the ignition strokes of the respective cylinders.

The indicated torque illustrated in FIG. 4 represents: an estimated value (dashed line) of an indicated torque calculated by the time series torque estimating unit 22 from the time series data of the crank angle and the time series data of the crank angular velocity; and an indicated torque correct value (solid line) calculated from cylinder internal pressure measured by a cylinder internal pressure sensor provided in each cylinder in an experiment performed in advance by operating an actual engine. In the present embodiment, in an experiment of the engine that is performed in advance, a conversion map or a conversion formula between the indicated torque estimated value and the indicated torque correct value of each cylinder is acquired. As illustrated in FIG. 5, the conversion map or the conversion formula is acquired for each cylinder and, as will be described later, the conversion map or the conversion formula is also acquired for each rotation region of the engine.

Figure 6:
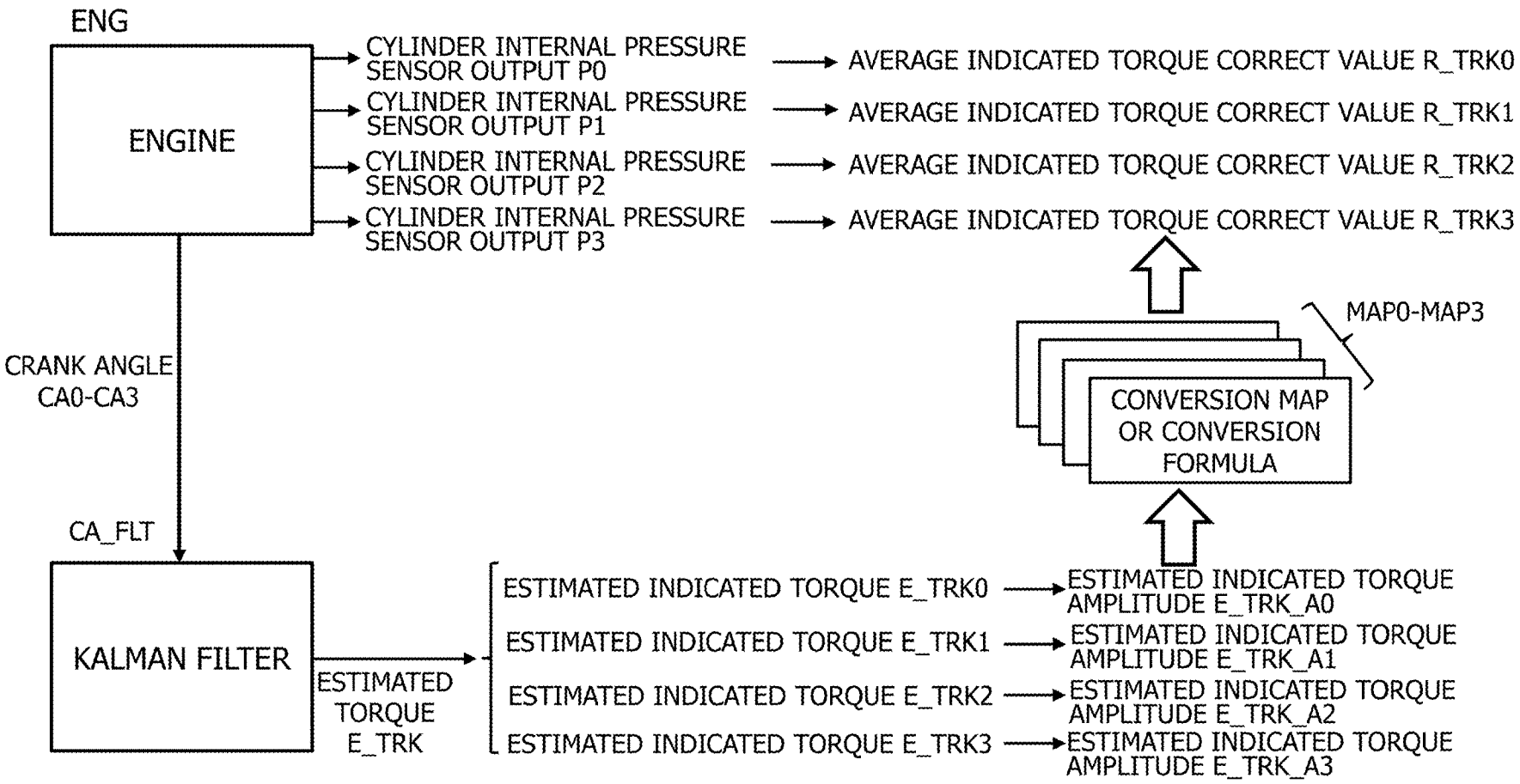
FIG. 6 is a diagram illustrating an experiment of an engine for acquiring a conversion map or a conversion formula.

FIG. 6 is a diagram illustrating an experiment of an engine for acquiring a conversion map or a conversion formula. A real engine ENG for an experiment is the engine illustrated in FIG. 5. Specifically, the crank shaft 50 is provided with the crank angle sensor CA, and when the engine is rotated, pieces of time series data CA0 to CA3 of a crank angle are extracted from a voltage output of the crank angle sensor CA. Unlike an engine that is actually mounted to a vehicle, in the engine ENG for an experiment, each of the cylinders CL0 to CL3 is provided with cylinder internal pressure sensors CP0 to CP3 which detect a physical state inside a cylinder such as cylinder internal pressure. With the exception of high-class engines, engines mounted to a vehicle are not provided with cylinder internal pressure sensors. This is because providing cylinder internal pressure sensors increase cost and, at the same time, cylinder internal pressure sensors problematically deteriorate over time.

The engine for an experiment is rotated and time series data of pressure P0 to P3 in each cylinder is acquired from each cylinder internal pressure sensor CP0 to CP3 of the four cylinders. The correct values of the four indicated torques that are respectively created in the four cylinders are calculated from each cylinder internal pressure P0 to P3. The indicated torque correct values are indicated by a solid line in FIG. 4.

There is a relationship where that the higher the cylinder internal pressure in the ignition (combustion) stroke of a cylinder, the higher the indicated torque, and therefore the indicated torque is able to be accurately calculated from cylinder internal pressure in correspondence to a cylinder of the engine.

In addition, average indicated torque correct values R_TRK0 to R_TRK3 of the respective cylinders are calculated from the four indicated torque correct values. An average indicated torque is calculated by, for instance, integrating time series data of an indicated torque by a period of an ignition stroke and dividing the integrated value by a time of the ignition stroke.

On the other hand, pieces of time series data CA0 to CA3 of a crank angle are extracted from an output of the crank angle sensor provided in the engine ENG and input to a Kalman filter CA_FLT. While the time series data of a crank angle is extracted from an output of a single crank angle sensor, since the crank angles of the four cylinders are respectively offset by 180 degrees, the pieces of time series data CA0 to CA3 of the four crank angles are obtained by quartering the output of the crank angle sensor in consideration of the 180-degree offsets.

As will be described later, the Kalman filter CA-FLT calculates an estimated torque (an estimated indicated torque) E_TRK that is a state value of the engine while inputting the time series data of the crank angle. The estimated torque is indicated by a dashed line in FIG. 4. Since the estimated torque is generated by sequential ignition (combustion) of the four cylinders, by dividing the estimated indicated torque E_TRK that is calculated during the crank angle of 720 degrees into four estimated indicated torque E_TRK_0 E_TRK_3 of the four ignition strokes performed by the four cylinders, respective estimated indicated torques E_TRK0 to E_TRK3 of the four cylinders are extracted.

However, due to a limit of measurement resolution in crank angle extraction, a limit of a sampling period of an output of a crank angle sensor, a disturbance such as vibration inside the engine in a high-rotation region, and the like, the time series data of the crank angle and the time series data of crank angular velocity that is calculated therefrom contain noise. In particular, at high rotation, the vibration inside the engine or the limit of the sampling period becomes prominent, and a degree of the limit of the sampling period differs in accordance with a different region of the number of rotations of the engine. The influence rates of them also differ in accordance with individual variability of the four cylinders. In addition, the estimated indicated torques of the respective cylinders that are estimated from the time series data of the crank angle and the time series data of the crank angular velocity contain different noises based on individual variability of the plurality of cylinders (such as individual variability of the injectors).

In consideration thereof, in the present embodiment, as illustrated in FIG. 6, the experiment of the engine described above is performed in advance to acquire conversion maps or conversion formulas MAP0 to MAP3 including respective correspondences between estimated indicated torque-related values such as estimated indicated torque amplitudes E_TRK_A0 to E_TRK_A3 or integrated values of the estimated indicated torques of the four cylinders and average indicated torque correct values R_TRK0 to R_TRK3. The conversion map or the conversion formula is acquired for each of the four cylinders. In addition, as will be described later, the conversion map or the conversion formula is acquired for each rotation region of the engine for each cylinder.

In particular, in the present embodiment, an effect of noise contained in a sensor value of a crank angle sensor is suppressed by adopting an estimated indicated torque amplitude as the estimated indicated torque-related value.

Figure 7:
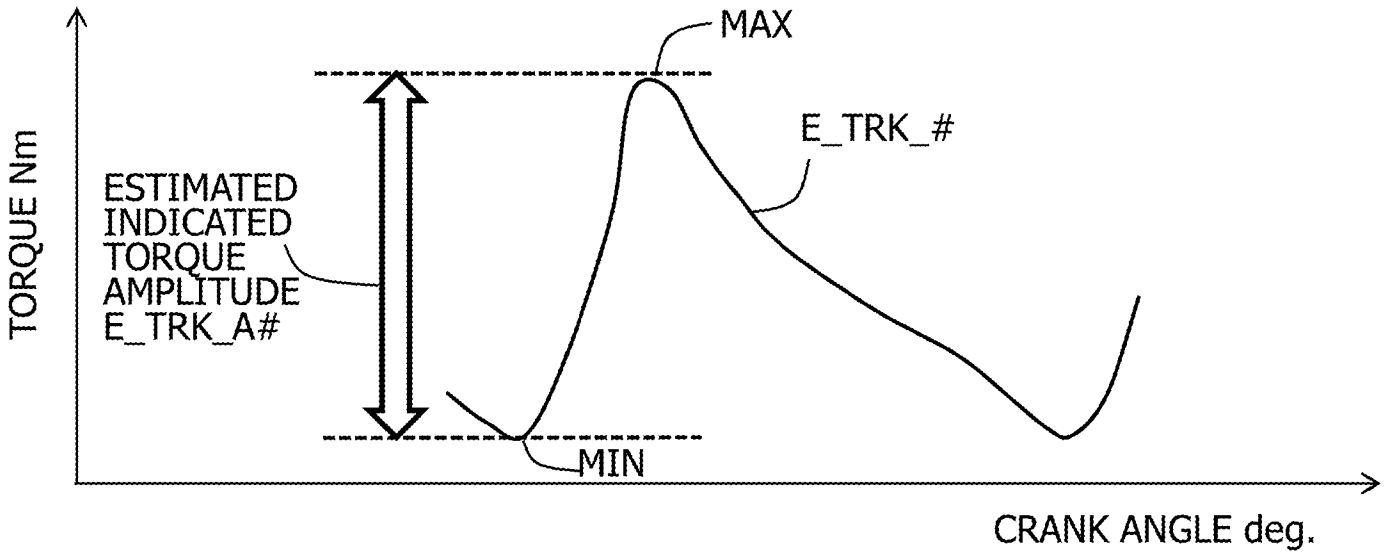
FIG. 7 is a diagram illustrating an estimated indicated torque amplitude.

FIG. 7 is a diagram illustrating an estimated indicated torque amplitude. FIG. 7 illustrates an estimated indicated torque E_TRK # (where # denotes a cylinder number 0 to 3) of a given cylinder. A single ignition cycle of the estimated indicated torque that is a dashed line illustrated in FIG. 4 has been excerpted and is illustrated in FIG. 7. In the crank angle sensor, noise is generated in a sensor value before and after a missing tooth that is provided among the plurality of teeth of the rotor. When calculating an integrated value of the estimated indicated torque, noise due to the missing tooth needs to be removed by interpolation processing or the like, but there may be cases where the generated noise may not be suitably removed even by performing such processing.

By contrast, in the present embodiment, an individual cylinder torque-related value (amplitude) extracting unit 23 illustrated in FIG. 2 extracts an estimated indicated torque amplitude E_TRK_A # (23A) based on a difference between a maximum value MAX and a minimum value MIN of an estimated indicated torque E_TRK # (S23). # is 0 to 3. Extracting the estimated indicated torque amplitude E_TRK_A # (23A) enables an effect of noise generated by the missing tooth included in the estimated indicated torque E_TRK # to be significantly suppressed. The estimated indicated torque amplitude E_TRK_A # is extracted with respect to each of the four cylinders.

Next, an individual cylinder average indicated torque acquiring unit 24 based on the individual cylinder torque-related value (amplitude) illustrated in FIG. 2 acquires an average indicated torque correct value R_TRK # (S24A) of each cylinder that corresponds to each estimated indicated torque amplitude E_TRK_A# of each cylinder. Specifically, the acquiring unit 24 acquires the average indicated torque correct value R_TRK # that corresponds to the estimated indicated torque amplitude E_TRK_A # (an estimated indicated torque-related value) based on a conversion map or a conversion formula calculated from the conversion map. As described earlier, extracting the estimated indicated torque amplitude E_TRK_A # enables noise due to the missing tooth of the crank angle sensor to be suitably suppressed. Therefore, accuracy of the average indicated torque correct value R_TRK # corresponding to the estimated indicated torque amplitude E_TRK_A # that is acquired based on a conversion map or a conversion formula is able to be increased.

Figure 8:
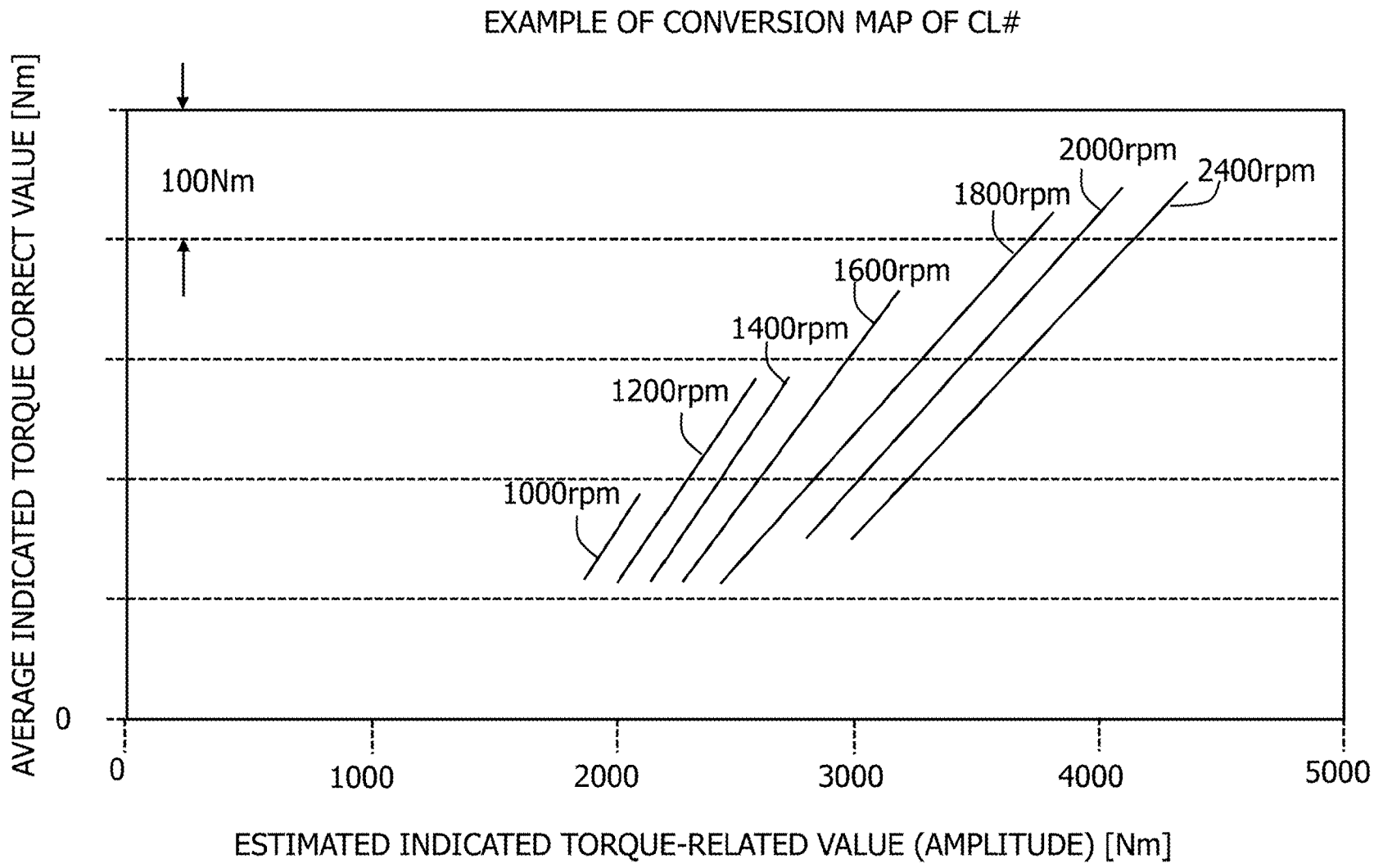
FIG. 8 is a diagram illustrating an example of a conversion map or a conversion formula.

FIG. 8 is a diagram illustrating an example of a conversion map or a conversion formula. As described earlier, in the present embodiment, in an experiment involving rotating an engine that is performed in advance, a conversion map or a conversion formula MAP0 to MAP3 including a correspondence between the estimated indicated torque-related value (amplitude) E_TRK_A # and the average indicated torque correct value R_TRK # is acquired for each of the four cylinders. Furthermore, the conversion map or the conversion formula of each cylinder is acquired for each region of the number of rotations of the engine. Specifically, while the region of the number of rotations of the engine is changed in the experiment, the conversion map or the conversion formula MAP0 to MAP3 is acquired for each region of the number of rotations.

In FIG. 8, an abscissa corresponds to an estimated indicated torque-related value and, in particular, to an estimated indicated torque amplitude, and an ordinate corresponds to an average indicated torque correct value. The average indicated torque correct value is calculated by, for instance, calculating an integrated value in the ignition (combustion) stroke of each cylinder of an indicated torque correct value having been calculated from a cylinder internal pressure sensor and then dividing the integrated value by a time of the ignition (combustion) stroke.

As indicated by the example of the conversion map or the conversion formula illustrated in FIG. 8, since there is a linear relationship between an estimated indicated torque amplitude and an average indicated torque correct value, an average indicated torque correct value with respect to an estimated indicated torque amplitude can be uniquely acquired according to the conversion map or the conversion formula.

As indicated by the example of the conversion map or the conversion formula illustrated in FIG. 8, when the conversion map or the conversion formula of each region of the number of rotations of the engine of 1000 rpm, 1200 rpm, 1400 rpm, 1600 rpm, 1800 rpm, 2000 rpm, and 2400 rpm is acquired, a decline in conversion accuracy due to an increase in noise generated in an estimated indicated torque as the number of engine rotations increases is able to be suppressed. The 1000 rpm region of the number of rotations of the engine is, for instance, a region of 1000 rpm or higher and lower than 1200 rpm. The other regions of the number of rotations are identical regions as 1200 rpm.

As is apparent from the example illustrated in FIG. 8, a conversion map or a conversion formula is approximately a linear function. The conversion map includes correspondences between a plurality of estimated indicated torque-related values (amplitudes) and a plurality of average indicated torque correct values. On the other hand, the conversion formula is a formula of a linear function of which an estimated indicated torque-related value (amplitude) is a variable X and an average indicated torque correct value is a variable Y.

Figure 9:
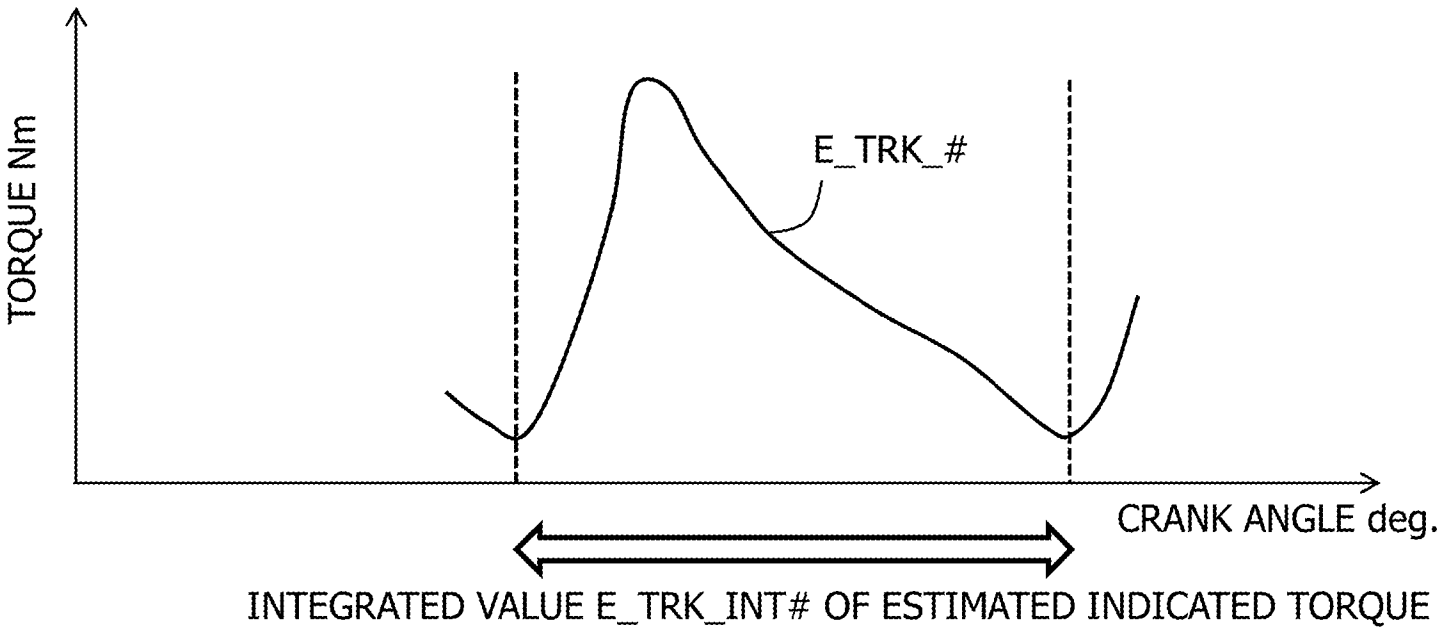
FIG. 9 is a diagram illustrating an integrated value that represents another example of an estimated indicated torque-related value.

FIG. 9 is a diagram illustrating an integrated value that represents another example of an estimated indicated torque-related value. In a same manner to FIG. 7, FIG. 9 illustrates an estimated indicated torque E_TRK # (where # denotes a cylinder number 0 to 3) of a given cylinder. A single cycle of the estimated indicated torque that is a dashed line illustrated in FIG. 4 has been excerpted and is illustrated in FIG. 9. An estimated indicated torque integrated value E_TRK_INT # is an integrated value during an ignition (combustion) stroke of an estimated indicated torque E_TRK #. An estimated average indicated torque is able to be calculated by dividing the integrated value by a time of the ignition stroke. The estimated indicated torque integrated value E_TRK_INT # and the estimated average indicated torque obtained by dividing the integrated value by time only differ from one another in whether or not a division by time has been performed and both represent data having a same meaning within a conversion map.

In the present embodiment, the estimated indicated torque integrated value illustrated in FIG. 9 is used in place of the estimated indicated torque amplitude illustrated in FIG. 7 as the abscissa of the conversion map or the conversion formula illustrated in FIG. 8. Even when such a conversion map or a conversion formula is used, the acquiring unit 24 is able to acquire an average indicated torque correct value with high accuracy.

Returning now to FIG. 2, the torque feedback (FB) control unit 31 calculates a fuel injection amount 31A of each cylinder so that an average indicated torque correct value 24A per cylinder matches a torque target value 33A output by the torque target value setting unit 33 (S31). Specifically, the torque FB control unit 31calculates the fuel injection amount 31A of each cylinder based on a difference between the torque target value 33A and the average indicated torque correct value 24A. The fuel injection amount 31A is due to feedback control. In this case, the torque target value setting unit 33 sets a torque target value based on, for instance, a driver-needed torque based on an operation amount of an accelerator by a driver or a needed torque output from cruise control or the like.

On the other hand, the torque feed-forward (FF) control unit 34 calculates a fuel injection amount 34A of all cylinders based on an engine internal state value 41A such as the number of rotations from the engine ENG and the torque target value 33A output by the torque target value setting unit 33 (S34). Specifically, the fuel injection amount is calculated by referring to a map including a feed-forward fuel injection amount in correspondence to a combination of the number of rotations of the engine and a torque target value. The calculated feed-forward fuel injection amount is an injection amount common to all cylinders.

Next, the determining unit 32 of instructed injection amount to the injector receives the feed-forward fuel injection amount 34A and the feedback fuel injection amount 31A for each cylinder as input and determines an instructed injection amount (an instructed value of injection amount) 32A to the injector of each cylinder according to, for instance, PID (Proportional Integral Differential) control. In addition, an injector drive control unit 40 generates a drive signal 40A for driving the injector of each cylinder based on the instructed value of injection amount 32A of each cylinder (S40). The injector of each cylinder in the engine is driven by the drive signal 40A of each cylinder (S40).

[Kalman Filter]

In the present embodiment, the time series torque estimating unit 22 illustrated in FIG. 2 calculates an indicated torque estimated value of a time series using an unscented Kalman filter as a nonlinear Kalman filter. Hereinafter, the nonlinear Kalman filter will be described in detail.

The time series torque estimating unit 22 calculates, according to mathematical expression (4) below, an error between an actually-measured value θ(k) of a crank angle having been acquired by the crank angle sensor CA and a priori estimated value θ^−(k) the crank angle as calculated by a nonlinear Kalman filter to be described later.

[Math. 4]

$$\Delta\theta(k)=\theta(k)-\hat{\theta}^{-l\,(}k) \tag{5}$$

In mathematical expression (4), k represents a period of the number of updates. In addition, the time series torque estimating unit 22 calculates, according to mathematical expression (5) below, an error between a calculated value θ·−(k) of a crank angular velocity and a priori estimated value θ·^−(k) of the crank angular velocity as calculated by the nonlinear Kalman filter to be described later.

[Math. 5]

$$\Delta\theta(k)=\dot{\theta}(k)-\hat{\dot{\theta}}^{-}(k) \tag{5}$$

As indicated in mathematical expression (6) below, a state estimated value x(k) according to the present embodiment includes the crank angle θ(k), the crank angular velocity θ·−(k), and an indicated torque τ(k).

[Math. 6]

$$x(k)=\begin{bmatrix}\theta(k)\\ \dot{\theta}(k)\\ \tau(k)\end{bmatrix} \tag{6}$$

In addition, in the nonlinear Kalman filter according to the present embodiment, when a state vector indicated in mathematical expression (6) above is provided, time series data of the crank angle and time series data of the crank angular velocity are calculated by a nonlinear function f and a nonlinear function h according to mathematical expressions (7) and (8) below.

[Math. 7]

$$x(k+1)=f(x(k),\ v(k)) \tag{7}$$

$$\begin{bmatrix}\theta(k)\\ \dot{\theta}(k)\end{bmatrix}=h(x(k),\ \omega(k)) \tag{8}$$

$$y(k)=\begin{bmatrix}\theta(k)\\ \dot{\theta}(k)\end{bmatrix}$$

In mathematical expressions (7) and (8), v(k) denotes system noise, w(k) denotes measured noise, and y(k) denotes a measured value (output value). The nonlinear function f and the nonlinear function h are functions including arbitrary coefficient functions and, in the present embodiment, the nonlinear function f and the nonlinear function h are expressed by nonlinear equations indicated in mathematical expressions (9-1) to (9-4) below.

[Math. 8]

$$\begin{cases}\dot{x}=f(x)=A(x)x\\ \quad y=h(x)=Cx\end{cases} \tag{9-1}$$

$$A(x)=\begin{bmatrix}0 & 1 & 0\\ 0 & z(x) & 1/a_{iner}(\theta)\\ 0 & 0 & 0\end{bmatrix} \tag{9-2}$$

$$z(x)=\frac{1}{a_{iner}(\theta)}\left(\frac{a_{gra}(\theta)}{\dot{\theta}}+a_{fri}(\theta)-a_{vel}(\theta)\dot{\theta}\right) \tag{9-3}$$

$$C=\begin{bmatrix}1 & 0 & 0\\ 0 & 1 & 0\end{bmatrix} \tag{9-4}$$

In the nonlinear state equations indicated in mathematical expressions (9-1) to (9-4) above, a measured value θ(k) of the crank angle of a period k at a present time point, a calculated value θ·(k) of the crank angular velocity of the period k at the present time point, and a value τ(k) of torque of the period k at the present time point of the state estimated value x(k) indicated in mathematical expression (6) are input. In addition, a crank angle θ(k+1) of a period k+1 at a next time point, a crank angular velocity θ·(k+1) of the period k+1 at the next time point, and a torque τ(k+1) of the period k+1 at the next time point are estimated In mathematical expressions (9-2) and (9-3), $a_{iner}$ (8) denotes a term related to inertia of a piston-crank mechanism in an engine and $a_{gra}$ (θ) denotes a term related to gravity of the piston-crank mechanism. In addition, $a_{vel}$ (θ) denotes a term related to angular velocity of the piston-crank mechanism, and $a_{fri}$ (θ) denotes a term related to friction of the piston-crank mechanism. $a_{iner}$ (θ), $a_{gra}$ (θ), $a_{vel}$ (θ), and $a_{fri}$ (θ) are coefficient functions.

In the case of 4-cycle, in-line 4-cylinder, for instance, a no. 1 cylinder and a no. 4 cylinder are in a same phase in a same piston arrangement and a no. 2 cylinder and a no. 3 cylinder are in a same phase in a same piston arrangement. Therefore, in consideration of 4-cycle, in-line 4-cylinder, the term related to inertia, the term related to gravity, the term related to angular velocity, and the term related to friction are expressed by being superimposed while phases thereof are respectively shifted by 180 degrees as indicated in mathematical expression (9-5) below.

[Math. 9]

$$a_{iner}(\theta)=2(a_{iner_s}(\theta)+a_{iner_s}(\theta+\pi))$$

$$a_{gra}(\theta)=2(a_{gra_s}(\theta)+a_{gra_s}(\theta+\pi))$$

$$a_{vel}(\theta)=2(a_{vel_s}(\theta)+a_{vel_s}(\theta+\pi))$$

$$a_{fri}(\theta)=2(a_{fri_s}(\theta)+a_{fri_s}(\theta+\pi)) \quad (9\text{-}5)$$

$a_{iner_s}$ (θ) is a coefficient function of the term related to inertia in the case of a single cylinder, $a_{gra_s}$ (θ) is a coefficient function of the term related to gravity in the case of a single cylinder, $a_{vel_s}$ (θ) is a coefficient function of the term related to angular velocity in the case of a single cylinder, and $a_{fri_s}$ (θ) is a coefficient function of the term related to friction in the case of a single cylinder.

In the present embodiment, calculations are performed by replacing a mathematical expression calculation portion of the coefficient functions described above by a table that represents a relationship between output values of the coefficient functions and θ values. Specifically, a table is set in advance which represents a relation between an output value of the term $a_{iner}$ (θ) related to inertia, an output value of the term $a_{gra}$ (θ) related to gravity, an output value of the term $a_{vel}$ (θ) related to angular velocity, and an output value of the term $a_{fri}$ (θ) related to friction and the crank angle θ.

Figure 10:
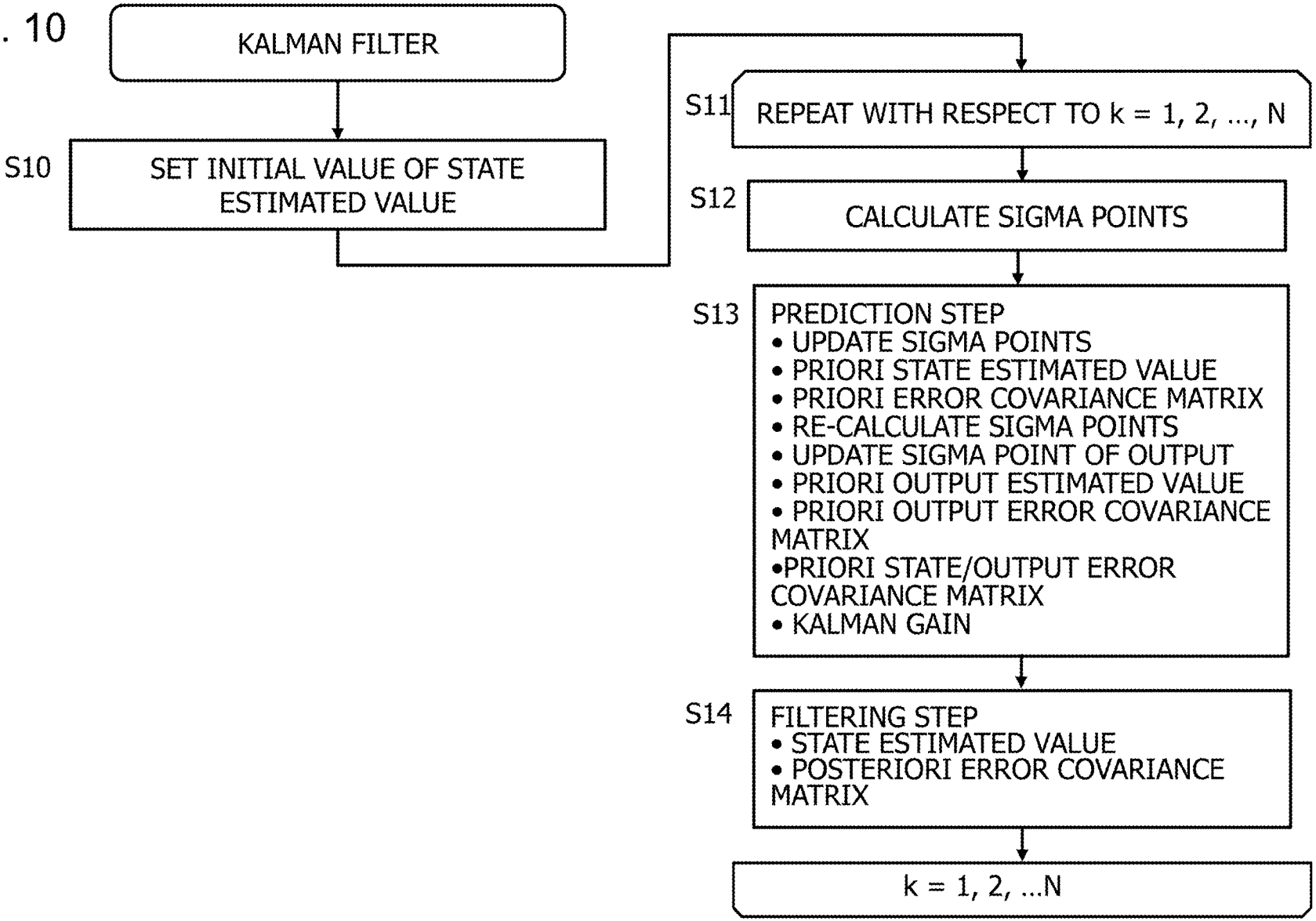
FIG. 10 is a diagram illustrating a flow chart of arithmetic processing of a nonlinear Kalman filter according to the present embodiment.

FIG. 10 is a diagram illustrating a flow chart of arithmetic processing of a nonlinear Kalman filter according to the present embodiment. Hereinafter, arithmetic processing of the nonlinear Kalman filter will be described according to the flow chart.

[Setting Initial Value of State Estimated Value (S10)]

The time series torque estimating unit 22 sets an initial value x^(0) of a state estimated value x^(k) as indicated in mathematical expression (10) below.

[Math. 10]

$$\hat{x}(0)=\begin{bmatrix}\theta(0)\\ \dot{\theta}(0)\\ \tau(0)\end{bmatrix} \quad (10)$$

Next, the time series torque estimating unit 22 sets an initial value P(0) of a posteriori error covariance matrix $P_0$ as indicated in mathematical expression (11) below. In addition, a variance Q of system noise and a variance R of measured noise are set.

[Math. 11]

$$P(0)=P_0 \quad (11)$$

[Time Update (S11)]

Next, in addition, the time series torque estimating unit 22 repetitively executes processing below for each predetermined period. In this case, for instance, update processing is repetitively performed at each period K=1 to 2, 3, . . . , N (S11).

[Calculation of Sigma Point (S12)]

First, from a state estimated value x^(k−1) and a covariance matrix P(k−1) of an immediately previous period, the time series torque estimating unit 22 calculates 2n+1 number of sigma points $\sigma_0$, $\sigma_i$ as sample points corresponding to an average value and a standard deviation according to mathematical expression (12) (a sample point corresponding to an average value) and mathematical expressions (13) and (14) (a sample point corresponding to a standard deviation) below (S12).

[Math. 12]

$$\sigma_0(k-1)=\hat{x}(k-1) \quad (12)$$

$$\sigma_i(k-1)=\hat{x}(k-1)+\sqrt{n+k}(\sqrt{P(k-1)})_i \ (i=1,2,\ldots,n) \quad (13)$$

$$\sigma_{n+i}(k-1)=\hat{x}(k-1)-\sqrt{n+k}(\sqrt{P(k-1)})_i \ (i=1,2,\ldots,n) \quad (14)$$

In the mathematical expressions, $(\sqrt{P})_i$ represents an i-th column of a square root matrix of a covariance matrix P. In addition, weights $w_0$, $w_i$ with respect to each sigma point are calculated according to mathematical expressions (15) and (16) below.

[Math. 13]

$$w_0=\frac{\kappa}{n+\kappa} \quad (15)$$

$$w_i=\frac{1}{2(n+\kappa)} \quad (16)$$

$$(1=1,2,\ldots,2n)$$

In mathematical expressions (15) and (16), K denotes a scaling parameter. A priori state estimated value x^−(k) and a priori error covariance matrix P−(k) that are calculated by mathematical expressions (19) and (20) are respectively referred to as estimated values of a primary moment and a secondary moment. The estimated values of the primary moment and the secondary moment have accuracy until a square term of a Taylor series expansion of f (x(k), v(k)) with respect to an arbitrary nonlinear function. Since estimated values of moments of third or higher orders contain an error, K is a parameter for adjusting an effect of such an error. Semi-positive definiteness is guaranteed by selecting K to be 0 or larger. Normally, K is often set to 0.

[Prediction Step (S13)]

Next, the time series torque estimating unit 22 updates the sigma point $\sigma_i$ using the nonlinear function f according to mathematical expression (18) below.

[Math. 14]

$$\sigma_i^-(k)=f(\sigma_i(k-1)) \ (i=0,1,2,\ldots,2n) \quad (18)$$

Next, the time series torque estimating unit 22 calculates a priori state estimated value x^−(k) according to mathematical expression (19) below using a sigma point $\sigma_i$−(k) and the weight $w_i$.

[Math. 15]

$$\hat{x}^-(k) = \sum_{i=0}^{2n} w_i \sigma_i^-(k) \tag{19}$$

Next, the time series torque estimating unit 22 calculates a priori error covariance matrix P−(k) according to mathematical expression (20) below using the sigma point $\sigma_i$−(k) and the priori state estimated value x^−(k). b in mathematical expression (20) below denotes a coefficient matrix of system noise.

[Math. 16]

$$P^-(k) = \sum_{i=0}^{2n} w_i(\sigma_i^-(k) - \hat{x}^-(k))(\sigma_i^-(k) - \hat{x}^-(k))^T + Qbb^T \tag{20}$$

Next, the time series torque estimating unit 22 re-calculates the 2n+1 number of sigma points according to mathematical expressions (21), (22), and (23) below using the priori state estimated value x^−(k) and the priori error covariance matrix P−(k).

[Math. 17]

$$\sigma_0^-(k)=\hat{x}^-(k) \tag{21}$$

$$\sigma_i^-(k)=\hat{x}^-(k)+\sqrt{n+k}(\sqrt{P^{31}(k)})_i \ (i=1,2, \ldots, n) \tag{22}$$

$$\sigma_{n+i}^-(k)=\hat{x}^-(k)-\sqrt{n+k}(\sqrt{P^-(k)})_i \ (i=1,2, \ldots, n) \tag{23}$$

Next, the time series torque estimating unit 22 calculates a sigma point $\Psi_i$−(k) of output according to mathematical expression (24) below using the sigma point $\sigma_i$−(k) and the nonlinear function h.

[Math. 18]

$$\Psi_i^-(k)=h(\sigma_i^-(k) \ (i=0,1,2, \ldots ,2n) \tag{24}$$

Next, the time series torque estimating unit 22 calculates a priori output estimated value y^−−(k) according to mathematical expression (25) below using the sigma point $\Psi_i$−(k) of output of the expression (24).

[Math. 19]

$$\hat{y}^-(k) = \begin{bmatrix} \hat{\theta}^-(k) \\ \hat{\dot{\theta}}^-(k) \end{bmatrix} = \sum_{i=0}^{2n} w_i \Psi_i^-(k) \tag{25}$$

Next, the time series torque estimating unit 22 calculates a priori output error covariance matrix $P_{yy}$−(k) according to mathematical expression (26) below using the sigma point $\Psi_i$−(k) of output and the priori output estimated value y^−(k).

[Math. 20]

$$P_{yy}^-(k) = \sum_{i=0}^{2n} w_i(\Psi_i^-(k) - \hat{y}^-(k))^2 \tag{26}$$

Next, the time series torque estimating unit 22 calculates a priori state/output error covariance matrix $P_{xy}$−(k) according to mathematical expression (27) below using the priori state estimated value x^−(k), the priori error covariance matrix P−(k), the sigma point $\Psi_i$−(k) of output, and the priori output estimated value y^−(k).

[Math. 21]

$$P_{xy}^-(k) = \sum_{i=0}^{2n} w_i(\sigma_i^-(k) - \hat{x}^-(k))(\Psi_i^-(k) - \hat{y}^-(k)) \tag{27}$$

Next, the time series torque estimating unit 22 calculates a Kalman gain $K_g$(k) according to mathematical expression (28) below using the priori state/output error covariance matrix $P_{xy}$−(k), the priori output error covariance matrix $P_{yy}$−(k), and the variance R of measured noise.

[Math. 22]

$$K_g(k) = \frac{P_{xy}^-(k)}{P_{yy}^-(k) + R} \tag{28}$$

[Filtering Step (S14)]

Next, the time series torque estimating unit 22 estimates a state estimated value x^(k) from a priori state estimated value x^−(k) according to mathematical expression (29) below using the Kalman gain g(k), an error Δθ(k) related to a crank angle, and an error Δθ·(k) related to a crank angular velocity.

[Math. 23]

$$\hat{x}(k) = \hat{x}^-(k) + g(k)\begin{bmatrix} \Delta\theta(k) \\ \Delta\dot{\theta}(k) \end{bmatrix} \tag{29}$$

Next, the time series torque estimating unit 22 calculates a posteriori error covariance matrix P(k) to be used at the time of a next update according to mathematical expression (30) below using the priori error covariance matrix P−(k), the priori state/output error covariance matrix $P_{xy}$−(k), and the Kalman gain g(k).

[Math. 24]

$$P(k)=P^-(k)-g(k)(P_{xy}^-(k))^T \tag{30}$$

In addition, the time series torque estimating unit 22 estimates a torque to be generated in each cylinder based on time series data of the indicated torque T(k) among the state estimated value x^(k). Time series data of the estimated indicated torque to be generated in each cylinder is as indicated by the estimated value depicted by a dashed line in FIG. 4. As described earlier, the time series torque estimating unit 22 repetitively performs the calculations of mathematical expressions (12) to (30) at the predetermined periods k=1, 2, 3, . . . , N. This concludes the description of calculation processing of an indicated torque estimated value using a nonlinear Kalman filter.

As described above, according to the present embodiment, an engine torque estimating apparatus calculates time series data of an estimated indicated torque based on a crank angle that is detected by a crank angle sensor, respectively extracts estimated indicated torque-related values for each cylinder from the time series data of the estimated indicated torque for each cylinder, and converts, for each cylinder, the estimated indicated torque-related values into average indicated torque correct values having been calculated based on a cylinder internal state of an engine in correspondence to the estimated indicated torque-related values based on a conversion map or a conversion formula. Therefore, an average indicated torque correct value is able to be calculated with accuracy even when the crank angle that is detected by the crank angle sensor includes noise.

According to the first aspect, an indicated torque of each cylinder is able to be estimated with high accuracy.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

REFERENCE SIGNS LIST

CA Crank angle sensor
ENG Engine
10 Engine torque estimating apparatus and engine control apparatus
20 Engine torque estimating apparatus
22 Time series torque estimating unit
23 Individual cylinder torque-related value (amplitude) extracting unit
24 Acquiring unit of individual cylinder average indicated torque based on individual cylinder torque-related value (amplitude)
30 Engine control apparatus

The invention claimed is:

1. An engine torque estimating apparatus comprising:
a processor; and
a memory accessed by the processor,
the processor performs,
estimating a torque by calculating time series data of an estimated indicated torque, based on a crank angle having been extracted from an output of a crank angle sensor of an engine including a plurality of cylinders;
extracting an estimated indicated torque-related value by extracting an estimated indicated torque-related value, for each of the cylinders, from the time series data of the estimated indicated torque, for each of the cylinders; and
acquiring average indicated torque correct value by converting, for each of the cylinders, the estimated indicated torque-related value into an average indicated torque correct value having been calculated based on a cylinder internal state of an engine for an experiment, which is obtained from the engine for the experiment when the engine for the experiment was rotated, in correspondence to the estimated indicated torque-related value,
wherein the estimated indicated torque-related value is one of,
an estimated indicated torque amplitude that is a difference between a maximum value and a minimum value within a half-cycle of a rotation of a crank shaft in the time series data of the estimated indicated torque, and
an estimated indicated torque integrated value corresponding to the half-cycle.

2. The engine torque estimating apparatus according to claim 1, wherein the acquiring the average indicated torque correct value including converting the estimated indicated torque-related value into the average indicated torque correct value, for each number of engine rotations as well as for each of the cylinders.

3. The engine torque estimating apparatus according to claim 1, wherein
the average indicated torque correct value acquiring includes converting the estimated indicated torque-related value into the average indicated torque correct value, for each of the cylinders, by referring to a conversion map, for each of the cylinders, including the average indicated torque correct value in correspondence to the estimated indicated torque-related value.

4. The engine torque estimating apparatus according to claim 3, wherein
the conversion map is a conversion map for each number of engine rotations as well as for each pf the cylinders, and
the average indicated torque correct value acquiring includes performing the conversion for each number of engine rotations as well as for each of the cylinders.

5. The engine torque estimating apparatus according to claim 1, wherein
the average indicated torque correct value acquiring includes converting the estimated indicated torque-related value into the average indicated torque correct value, for each of the cylinders, based on a conversion formula which receives as an input the estimated indicated torque-related value, and which outputs the average indicated torque correct value.

6. The engine torque estimating apparatus according to claim 5, wherein
the conversion formula is a conversion formula for each number of engine rotations as well as for each pf the cylinders, and
the average indicated torque correct value acquiring includes performing the conversion for each number of engine rotations as well as for each of the cylinders.

7. The engine torque estimating apparatus according to claim 1, wherein the torque estimating includes calculating time series data of a crank angular velocity from the time series data of the crank angle and calculating time series data of the estimated indicated torque based on the time series data of the crank angular velocity and moment of inertia information of the engine.

8. The engine torque estimating apparatus according to claim 1, wherein the torque estimating includes estimating the state estimated value for each timing of a time series based on a nonlinear Kalman filter that uses the time series data of the crank angle and the time series data of the crank angular velocity that is calculated from the time series data of the crank angle, as measured values, and uses the time series data of the crank angle, the time series data of the crank angular velocity, and the estimated indicated torque, as a state estimated value.

9. An engine torque estimating method comprising:
estimating a torque by calculating time series data of an estimated indicated torque, based on a crank angle having been extracted from an output of a crank angle sensor of an engine including a plurality of cylinders;

extracting an estimated indicated torque-related value by extracting an estimated indicated torque-related value, for each of the cylinders, from the time series data of the estimated indicated torque, for each of the cylinders; and acquiring average indicated torque correct value by converting, for each of the cylinders, the estimated indicated torque-related value into an average indicated torque correct value having been calculated based on a cylinder internal state of an engine for an experiment, which is obtained from the engine for the experiment when the engine for the experiment was rotated, in correspondence to the estimated indicated torque-related value, wherein the estimated indicated torque-related value is one of, an estimated indicated torque amplitude that is a difference between a maximum value and a minimum value within a half-cycle of a rotation of a crank shaft in the time series data of the estimated indicated torque, and an estimated indicated torque integrated value corresponding to the half-cycle.

10. An engine control apparatus comprising:

a processor; and a memory accessed by the processor, the processor performs, an engine torque estimating that calculates, based on a crank angle having been extracted from an output of a crank angle sensor of an engine including a plurality of cylinders, an average indicated torque correct value, for each of the cylinders; and an injection amount determining that determines a fuel injection amount, for each of the cylinders, so that the average indicated torque correct value for each of the cylinders matches a needed torque, wherein the engine torque estimating includes:

estimating a torque by calculating time series data of an estimated indicated torque, based on the crank angle having been extracted from the output of the crank angle sensor of the engine including the plurality of cylinders;

extracting an estimated indicated torque-related value by extracting an estimated indicated torque-related value, for each of the cylinders, from the time series data of the estimated indicated torque, for each of the cylinders; and acquiring average indicated torque correct value by converting, for each of the cylinders, the estimated indicated torque-related value into an average indicated torque correct value having been calculated based on a cylinder internal state of an engine for an experiment, which is obtained from the engine for the experiment when the engine for the experiment was rotated, in correspondence to the estimated indicated torque-related value, wherein the estimated indicated torque-related value is one of, an estimated indicated torque amplitude that is a difference between a maximum value and a minimum value within a half-cycle of a rotation of a crank shaft in the time series data of the estimated indicated torque, and an estimated indicated torque integrated value corresponding to the half-cycle.

* * * * *